US008567750B2

(12) United States Patent
Amend

(10) Patent No.: US 8,567,750 B2
(45) Date of Patent: Oct. 29, 2013

(54) DEVICE HAVING BOTH NON-ABRADING AND FIRE-RESISTANT PROPERTIES FOR LINKING CONCRETE FORMWORK PANELS

(76) Inventor: Victor Amend, Toronto (CA)

( * ) Notice: Subject to any disclaimer, the term of this patent is extended or adjusted under 35 U.S.C. 154(b) by 610 days.

(21) Appl. No.: 12/007,487

(22) Filed: Jan. 11, 2008

(65) Prior Publication Data

US 2009/0179135 A1 Jul. 16, 2009

(51) Int. Cl.
*E04G 17/06* (2006.01)
*E04G 11/06* (2006.01)

(52) U.S. Cl.
USPC ..... 249/40; 52/426; 249/216

(58) Field of Classification Search
USPC ..... 52/426, 442; 249/214, 218, 216, 213, 249/41, 46, 40
See application file for complete search history.

(56) References Cited

U.S. PATENT DOCUMENTS

| | | | | | |
|---|---|---|---|---|---|
| 1,293,391 | A | * | 2/1919 | Ewing | 249/214 |
| 2,574,107 | A | * | 11/1951 | Joy | 411/529 |
| 2,969,619 | A | | 1/1961 | Didrick | |
| 3,236,490 | A | * | 2/1966 | Lovgren et al. | 249/45 |
| 3,625,470 | A | * | 12/1971 | Shoemaker | 249/214 |
| 4,079,910 | A | * | 3/1978 | Miller | 249/44 |
| 4,145,861 | A | | 3/1979 | Yarnick | |
| 4,241,555 | A | | 12/1980 | Dickens et al. | |
| 4,619,096 | A | | 10/1986 | Lancelot, III | |
| 4,953,334 | A | | 9/1990 | Dickens | |
| 5,792,481 | A | | 8/1998 | Creti | |
| 5,845,445 | A | | 12/1998 | Blackbeard | |
| 5,992,114 | A | * | 11/1999 | Zelinsky et al. | 52/426 |
| 6,236,791 | B1 | * | 5/2001 | Lausch et al. | 385/110 |
| 6,240,692 | B1 | * | 6/2001 | Yost et al. | 52/426 |
| 6,272,749 | B1 | | 8/2001 | Boeshart et al. | |
| 6,314,694 | B1 | | 11/2001 | Cooper et al. | |
| 6,363,683 | B1 | * | 4/2002 | Moore, Jr. | 52/741.13 |
| 6,438,918 | B2 | * | 8/2002 | Moore, Jr. et al. | 52/426 |
| 6,526,713 | B2 | | 3/2003 | Moore, Jr. | |
| 6,536,172 | B1 | | 3/2003 | Amend | |
| 7,827,752 | B2 | * | 11/2010 | Scherrer | 52/426 |
| 7,934,693 | B2 | * | 5/2011 | Bravinski | 249/40 |
| 2005/0034418 | A1 | | 2/2005 | Bravinski | |
| 2005/0108985 | A1 | * | 5/2005 | Bravinski | 52/782.1 |
| 2009/0120027 | A1 | * | 5/2009 | Amend | 52/426 |

OTHER PUBLICATIONS

SRI, Inc.; "Isorast 2000—Floor/Ceiling"; Internet web page; Oct. 22, 2003; http://www.isorast2000.com/artman/publish/floor.shtml.
Insul-Deck; "Lightweight Forming System for Concrete Floors and Roofs"; product brochure; 2002; www.insul-deck.org.

* cited by examiner

*Primary Examiner* — Janet M Wilkens

(57) ABSTRACT

A device for connecting and maintaining a first panel and a second panel of a concrete formwork in a fixed, spaced relationship during a wall building process includes a first connector embeddable within the first panel and having a non mold-abrading surface. A bridge links the first connector with the second panel, and at least a portion of the bridge is made of a fire-resistant material. Due to the properties of the device, it does not unduly scratch molding equipment during formation of an insulated panel in which it is to be embedded, and resists passage of smoke or flames through the formed concrete wall in the event of a fire.

5 Claims, 5 Drawing Sheets

DEVICE HAVING BOTH NON-ABRADING AND FIRE-RESISTANT PROPERTIES FOR LINKING CONCRETE FORMWORK PANELS

FIELD OF THE INVENTION

The present invention relates to forms for concrete walls, and more particularly to a device for connecting and maintaining a first panel and a second panel of a concrete formwork in a fixed, spaced relationship during a wall building process.

BACKGROUND OF THE INVENTION

Conventional formwork for forming walls from pourable building material such as concrete consist of two opposed, typically plywood walls connected by a rod, trusswork or other connecting structure. More recently, it has become desirable to use insulating material such as expandable polystyrene for the formwork, in order to provide thermal and acoustic insulation to the finished wall. In certain applications, particularly those where it is desired to inhibit the effects of "thermal inertia" of a concrete wall so as to employ the ability of the concrete to retain heat for temperature stabilization, it is desirable to employ formwork with insulated paneling on only one side. The other side, typically of plywood, may or may not be removed after full or at least partial curing of the concrete.

Various insulated formworks and related technologies have been considered. For example, U.S. Pat. No. 5,845,445 to Blackbeard discloses an insulated concrete form with a plurality of plywood boards at an inside surface, and a plurality of insulating foam panels at an outside surface. The plywood boards and insulating foam panels are connected by a plurality of elongated vertically aligned connecting members for retaining the panels in a spaced apart parallel relationship during the wall building process. The connecting members are connected to the insulating panels, and ties are attached to respective connecting members and the plywood boards. Each tie has a conventional embossed end to engage into a latch clip on the plywood side. During de-forming, the plywood boards may be removed by removing the attachment between the ties and latch clips.

U.S. Pat. No. 6,314,694 to Cooper et al. discloses a one-side insulated formwork that includes an insulating panel connectable to a removable panel by a connecting structure, which may provide permanent reinforcement embedded in the insulating panel. The removable panel is attached to the connecting structure using removable fasteners. The connecting structure maintains a fixed spaced relationship between the insulating panel and the removable panel, and according to embodiments disclosed includes rebar hooks for supporting rebar for embedding in the concrete. After the concrete has at least partially cured, the removable fasteners and removable panel are removed, leaving exposed and flush with the outer surface of the concrete wall a surface of the connecting structure suitable for flush connection of a finishing panel.

U.S. Pat. No. 6,526,713 to Moore, Jr. discloses an insulated concrete structure for forming walls from a pourable building material such as concrete. Moore proposed connecting two panels of a formwork using a web structure, a portion of which is preferably embedded in an insulating one of the panels. After the concrete has at least partially cured, one of the panels being now adjacent to the formed wall, may be removed or remain as part of the structure.

U.S. patent application Ser. No. 11/979,826 entitled "One-Sided Insulated Concrete Form" filed on Nov. 8, 2007 by Victor Amend and incorporated in its entirety herein by reference discloses a tie for connecting and maintaining first and second panels of a concrete formwork in a fixed, spaced relationship during a wall building process.

Although the above references disclose insulated formwork of various configurations, improvements are desired. For example, it has been discovered that in certain circumstances, ties that are made of plastic may pose fire safety concerns. In the event of a fire in a building having plastic ties embedded in concrete, the heat of the fire may cause melting of the plastic ties, thereby undesirably creating a passageway in the concrete wall through which smoke and flames can pass.

Ties that are made of metal better resist deformation due to heat, and therefore in the event of a fire do not generally create such passageways through which smoke and flames can pass. However, metal ties are more difficult than plastic ties to cut and otherwise manipulate in the field during construction of a form. Furthermore, unlike plastic ties, for concrete forms made using polystyrene panels, metal ties being placed in a mold or extrusion equipment for embedding in the polystyrene panel during its formation can tend to scratch and thereby damage the equipment.

It is therefore an object of an aspect of the present invention to provide a novel wall form device for connecting and maintaining a first panel and a second panel of a concrete formwork in a fixed, spaced relationship during a wall building process that addresses the above deficiencies.

SUMMARY OF THE INVENTION

According to an aspect, there is provided a device for connecting and maintaining a first panel and a second panel of a concrete formwork in a fixed, spaced relationship during a wall building process, the device comprising:

a first connector embeddable within the first panel and having a non mold-abrading surface; and a bridge for linking the first connector with the second panel, at least a portion of the bridge being made of a fire-resistant material.

According to another aspect, there is provided an insulating concrete wall formwork comprising:

a first panel made of an insulating material;

a second panel;

a first connector embeddable within the first panel and having a non mold-abrading surface;

a bridge linking the first connector with the second panel to maintain the first and second panels in a fixed, spaced relationship during the wall building process, at least a portion of the bridge being made of a fire-resistant material.

The device described herein provides previously-unrealized advantages because of its non mold-abrading and fire-resistant properties. For example, the device does not unduly scratch molding equipment during formation of an insulated panel in which it is to be embedded, yet resists the undesirable formation of a passageway through the formed concrete wall in the event of a fire.

BRIEF DESCRIPTION OF THE DRAWINGS

Embodiments will now be described more fully with reference to the accompanying drawings in which.

DETAILED DESCRIPTION OF THE EMBODIMENTS

In the following description, embodiments of a device for connecting and maintaining first and second panels of a formwork in a fixed, spaced relationship during a wall building process, and of a formwork including the device are provided.

Figure 1:
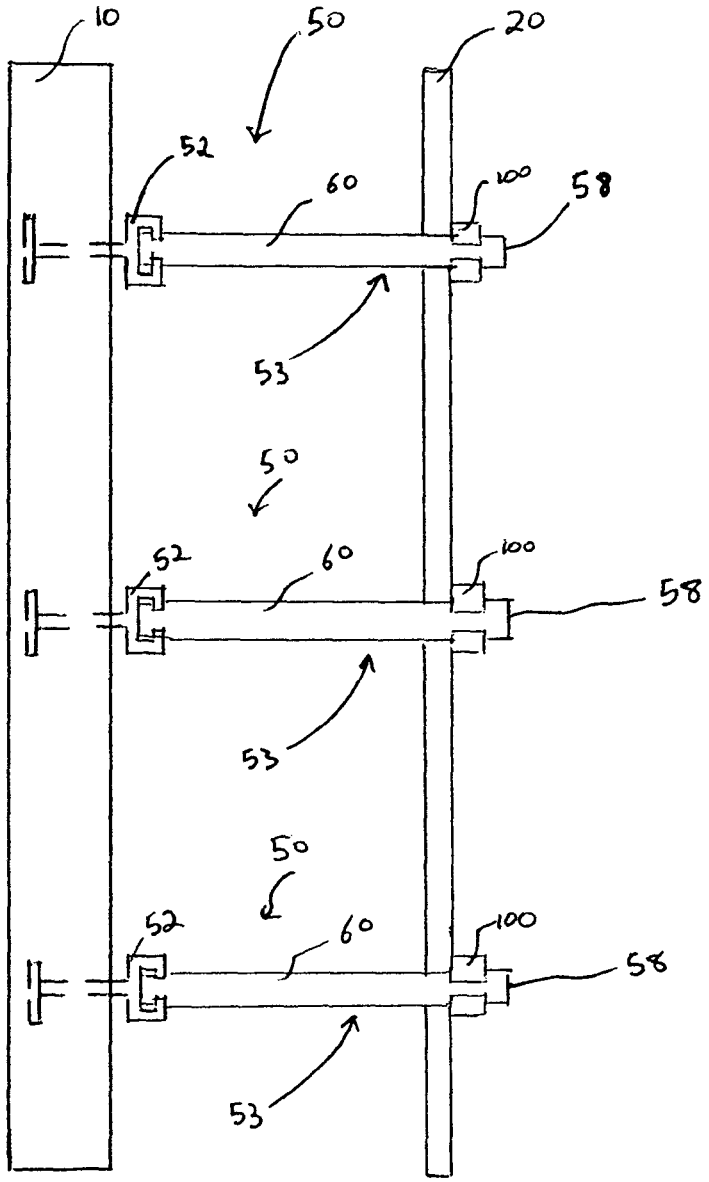
FIG. 1 is a top view of a formwork having first and second panels and a device for maintaining the first and second panels in a fixed, spaced relationship during a wall building process.

FIG. 1 is a top view of a formwork having a first panel 10 and a second panel 20. First panel 10 is an insulated panel made from expandable polystyrene (EPS) beads or pellets by way of a molding process. Second panel 20 is made of plywood. First panel 10 and second panel 20 are maintained in a fixed, spaced relationship during the wall building process by device 50. Device 50 includes a first connector 52 that is made of plastic and connected to first panel 10. First connector 52 is configured to be connected to first panel 10 by embedding during molding of first panel 10. During molding, first connector 52 is placed within the mold along with the EPS beads or pellets. Upon application of heat to the mold, the EPS expands and fuses together and also encloses first connector 52 so as to embed first connector 52 within the molded panel. Because first connector 52 is made of plastic, it does not abrade and thereby damage the steel mold when being placed inside the mold.

Device 50 also includes a bridge 53 for linking first connector 52 with the second panel 10 to thereby maintain the panels 10, 20 in a fixed, spaced relationship during the wall building process. Bridge 53 includes an intermediate portion 60 and a clip 100 for cooperating with intermediate portion 60 to connect bridge 53 to second panel 20. Intermediate portion 60 is made of metal. Because intermediate portion 60 is made of metal, it will resist fire in the sense that in typical fire conditions it will not melt or otherwise substantially deform. It will therefore resist the formation of a passageway through the formed concrete wall in the event of a fire.

Figure 2:
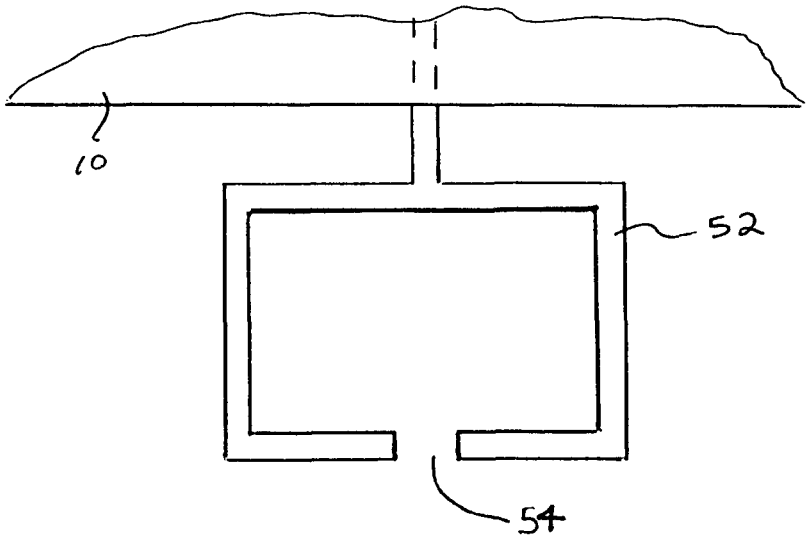
FIG. 2 is a top view of a portion of the first panel of FIG. 1 and a first connector of the device embedded therein.

FIG. 2 is a top view of a portion of the first panel 10 and the first connector 52 embedded therein. First connector 52 includes a throat 54.

Figure 3:
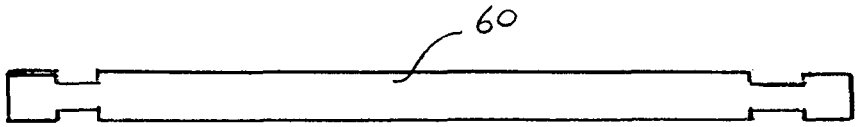
FIG. 3 is a top view of an intermediate portion of a bridge of the device of FIG. 1.
Figure 4:
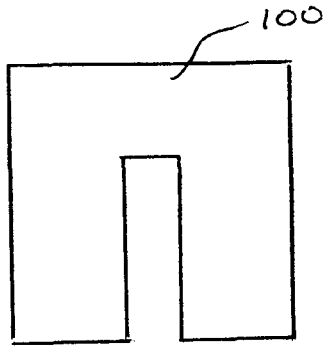
FIG. 4 is an elevational view of a clip for connecting the intermediate portion of the bridge to the first connector.

FIG. 3 is a top view of the intermediate portion 60 of bridge 53 in isolation. FIG. 4 is an elevational view of clip 100 for removably connecting an end of the intermediate portion 60 to second panel 20. Second panel 20 may therefore be removed after the wall building process, if desired.

Figure 5:
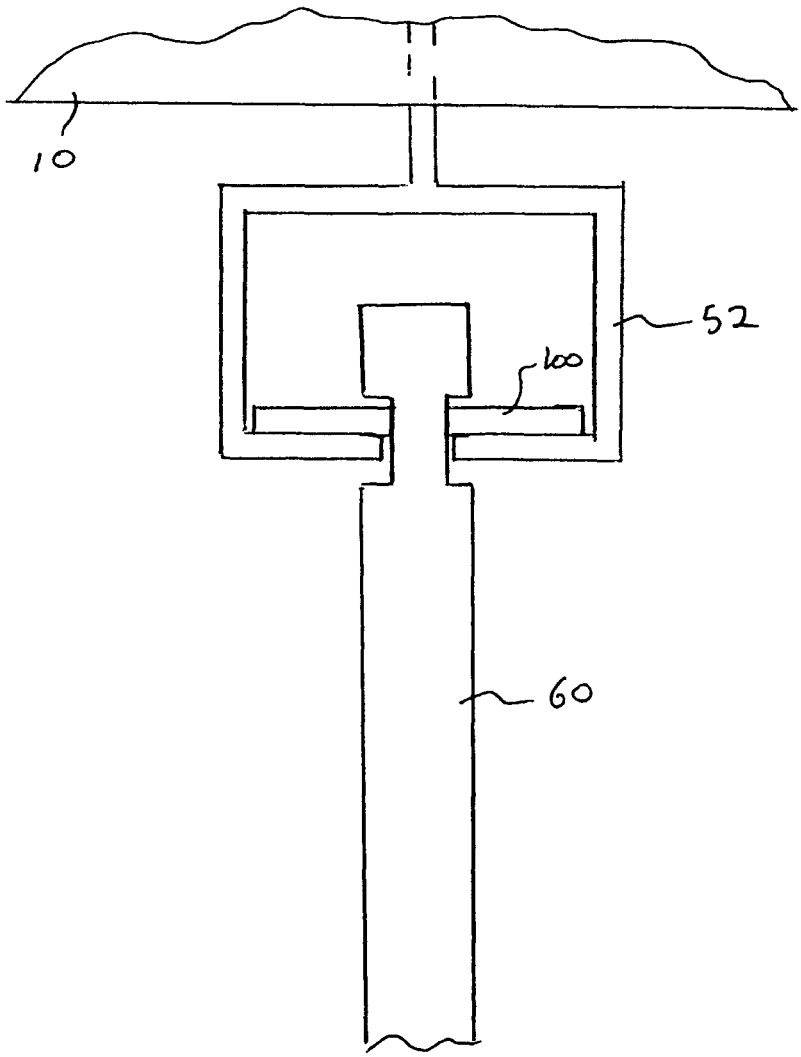
FIG. 5 is a top view of the intermediate portion of the bridge connected to the first connector with the clip of FIG. 4.

Another clip 100 is used to connect the opposite end of intermediate portion 60 to first connector 52. Intermediate portion 60 is dimensioned to cooperate with throat 54 of first connector 52 and clip 100 to connect intermediate portion 60 to first connector 52. This configuration is shown in FIG. 5, which is a top view of the intermediate portion 60 of bridge 53 connected to first connector 52 with clip 100.

Figure 6:
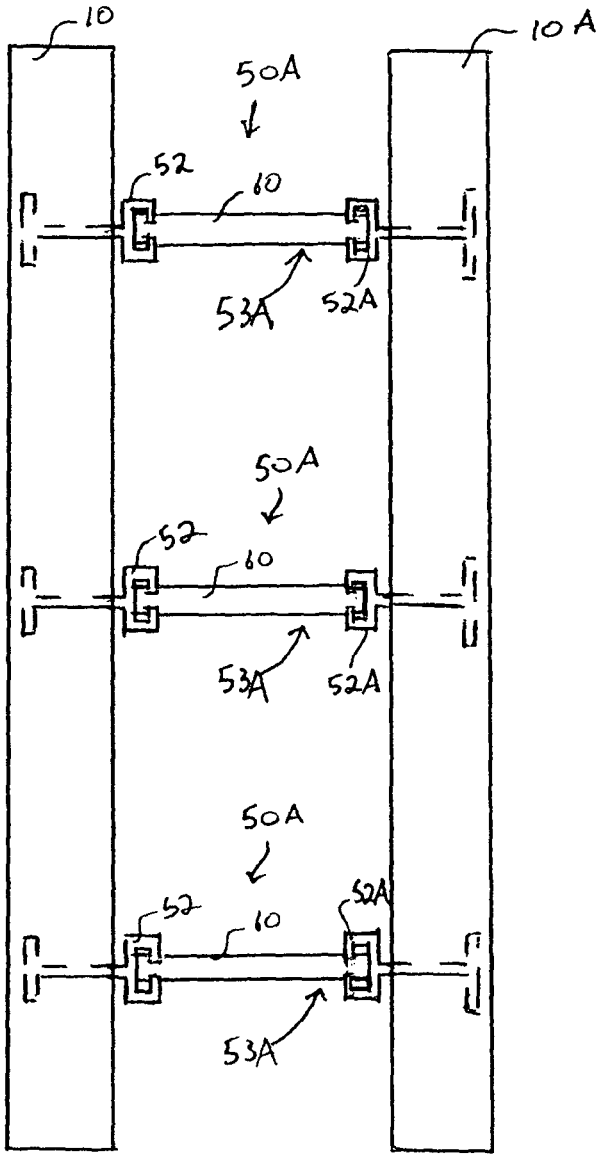
FIG. 6 is a top view of a formwork having first and second insulated panels and an alternative device for maintaining the first and second insulated panels in a fixed, spaced relationship during the wall building process.

Although a configuration of device 50 has been shown for use with a second panel 20 of plywood, other configurations are possible. For example, FIG. 6 shows a top view of a formwork having first and second insulated panels 10, 10A being maintained in a fixed, spaced relationship during the wall building process by alternative device 50A. Like device 50 shown in FIGS. 1 through 5, device 50A includes a first connector 52 embeddable within the first panel 10. However, in addition to intermediate portion 60, bridge 53A includes a second connector 52A that is made of plastic and embedded within second panel 10A. Like first connector 52, second connector 52A is configured to be connected to second panel 10A by being embedded within second panel 10A during molding of second panel 10A. This is done by placing second connector 52A within the mold along with EPS beads or pellets. Upon application of heat to the mold, the EPS expands and fuses together and also encloses second connector 52A so as to embed second connector 52A within the molded panel. Because second connector 52A is made of plastic, like first connector 52 it does not abrade and thereby damage the steel mold when being placed inside the mold.

In the embodiment of FIG. 6, intermediate portion 60 may be connected at its respective ends to first and second connectors 52, 52A using clips 100 (not shown in FIG. 6). In alternative embodiments, intermediate portion 60 may itself be dimensioned to cooperate with first and second connectors 52, 52A so as to not require clips 100.

It will be understood that while first and second connectors 52,52A have been described above as being made entirely of plastic, other materials that are non mold-abrading may be used. For example, high impact polystyrene may be used. Furthermore, it is not imperative that first and second connectors 52, 52A be made entirely of a non mold-abrading material. It is important rather that the surfaces of the first and second connectors 52, 52A that are to be placed in a mold be non mold-abrading. As such, embodiments may be conceived of whereby a coating or lamination of non mold-abrading material is applied to a core made of an otherwise mold-abrading material such as metal. This might be useful in the case where panels 10 and 10A are used, and the first and second connectors 52, 52A and bridge 60 are all or partly made from a single piece of metal. In this case, the first and second connectors 52, 52A would be coated in plastic or other non mold-abrading material to prevent or reduce damage to the mold. Alternatively, in the case where panels 10 and 20 are used, the first connector 52 and bridge might be made from a single piece of metal, with the first connector 52 coated in plastic or other non mold-abrading material to prevent or reduce damage to the mold.

It will also be understood that while embodiments have been shown in which the entire span of intermediate portion 60 is made of metal, other fire-resistant materials may be used. Furthermore, it is not imperative that the entire span of intermediate portion 60 be made of metal, or even that intermediate portion 60 be made of one piece. Rather, it is important that at least a portion of the length of intermediate portion 60 that is to be embedded in the concrete wall be made of fire-resistant material. Thus, there is at least a portion of intermediate portion 60 that will resist melting or otherwise substantially deforming in the event of a fire. As such, there will always remain a "plug" of sorts even under duress of heat to prevent flame or smoke from passing through the wall. Even if designs are employed in which the majority of intermediate portion 60 is not made of a fire-resistant material, the plug effect of the fire-resistant portion will still prevent smoke and flames from passing through the wall this way.

Although embodiments have been described, those of skill in the art will appreciate that variations and modifications may be made without departing from the spirit and scope thereof as defined by the appended claims.

What is claimed is:

1. An insulating concrete wall formwork comprising:

a first panel made of an insulating material;

a second panel;

a first connector enclosed within the first panel and having a non mold-abrading surface;

a bridge linking the first connector with the second panel to maintain the first and second panels in a fixed, spaced relationship during the wall building process, at least a portion of the bridge being made of a fire-resistant material, wherein the bridge is removably connected to the second panel to enable removal of the second panel away from a concrete wall after formation of the concrete wall; and a clip for removably connecting the bridge to the second panel.

2. The insulating concrete wall formwork of claim 1, wherein the first connector is made entirely of a non mold-abrading material.

3. The insulating concrete wall formwork of claim 2, wherein the non mold-abrading material is plastic.

4. The insulating concrete wall formwork of claim 1, wherein the fire-resistant material is metal.

5. The insulating concrete wall formwork of claim 1, wherein the second panel is made of plywood.

* * * * *